US007331875B2

(12) United States Patent
Sherman

(10) Patent No.: US 7,331,875 B2
(45) Date of Patent: Feb. 19, 2008

(54) ATTACHABLE SENSOR FOR PUTTING STROKE PATH AND PLANE DETECTION

(75) Inventor: Robyn Ann Sherman, Coombabah (AU)

(73) Assignee: Audio Coach Pty Ltd., Killara, NSW (AU)

( * ) Notice: Subject to any disclaimer, the term of this patent is extended or adjusted under 35 U.S.C. 154(b) by 161 days.

(21) Appl. No.: 10/529,936

(22) PCT Filed: Oct. 3, 2003

(86) PCT No.: PCT/AU03/01306

§ 371 (c)(1),
(2), (4) Date: Mar. 31, 2005

(87) PCT Pub. No.: WO2004/030771

PCT Pub. Date: Apr. 15, 2004

(65) Prior Publication Data

US 2006/0084517 A1 Apr. 20, 2006

(30) Foreign Application Priority Data

Oct. 3, 2002 (AU) ..... 2002951816
Feb. 21, 2003 (AU) ..... 2003900831

(51) Int. Cl.
*A63B 69/36* (2006.01)

(52) U.S. Cl. ..... 473/221; 473/223; 473/224

(58) Field of Classification Search ..... 473/213, 473/219–224, 226, 231, 232–234
See application file for complete search history.

(56) References Cited

U.S. PATENT DOCUMENTS 3,766,538 A * 10/1973 Dealy ..... 340/573.1
4,789,160 A * 12/1988 Dollar et al. ..... 473/223
4,930,787 A 6/1990 Nobles, Jr.
5,082,283 A * 1/1992 Conley et al. ..... 473/234
5,169,151 A * 12/1992 Conley ..... 473/220
5,184,826 A * 2/1993 Hall, Jr. ..... 473/224
5,199,712 A * 4/1993 Hoyle et al. ..... 473/209
5,435,561 A 7/1995 Conley
5,441,269 A 8/1995 Henwood
5,836,829 A 11/1998 Van Cott et al.
5,911,635 A * 6/1999 Ogden ..... 473/224
5,941,779 A 8/1999 Zeiner-Gundersen
6,530,845 B1 3/2003 Corbett

FOREIGN PATENT DOCUMENTS

EP 0 098 519 1/1984
EP 0 291 621 11/1988
FR 2 513 752 4/1983

* cited by examiner

*Primary Examiner*—Nini F. Legesse
(74) *Attorney, Agent, or Firm*—Workman Nydegger

(57) ABSTRACT

A putter trainer device for detecting inaccuracies in a golf puffing stroke. The puffing trainer device of the present invention is releasably (2) attached to a shaft of a golf putter and comprises two guided ramps (19A, 19B) with each ramp having an active position and a neutral position. In one embodiment, a free rolling disc magnet (20A, 20B) is located upon each guided ramp and each free rolling disc magnet is biased towards the neutral position (23A, 23B) on its respective ramp. The movement of either free rolling magnet from the neutral position to the active position is detected by magnetic reed switches (25A, 25B) located adjacent each ramp. A speaker is activated when the magnetic reed switches detect that either free rolling magnet has moved from the neutral position to the active position.

11 Claims, 5 Drawing Sheets

ATTACHABLE SENSOR FOR PUTTING STROKE PATH AND PLANE DETECTION

FIELD OF THE INVENTION

This invention relates to a device for detecting inaccuracies in a puffing stroke for the game of golf. In particular, this invention relates to a sensor that detects imperfections in smoothness of stroke, path of the putter head and face angle of the club head during a putting stroke.

BACKGROUND OF THE INVENTION

The game of golf is one of the most popular recreational sports in the world in terms of participants. The popularity of golf does not mean that the game is easy. Golf requires consistent precision of movement to achieve mastery of the game. Subtle imperfections in the execution of strokes produce amplified errors in the outcome of the shot.

Being able to putt in a technically correct manner is of vital importance to all golfers from the high handicap, weekend club player to the professional, as putting is where most strokes are dropped during a round. This is acknowledged in one of the most commonly used phrases on the golf course, "drive for show, putt for dough". Putting is also one of the hardest aspects of the game to master. There are four main technical inaccuracies that are common among players. These inaccuracies cause inconsistent swings and hence missed putts.

1. Professionals cite rotation of the wrists during back swing, the transition from back swing to forward swing, or forward swing resulting in rotation of the club in a direction axial to the vertical axis as the primary reason for inaccurate putting strokes. The club head should remain perpendicular to the intended line of travel of the ball during the backstroke.
2. Another reason for inaccurate putting is due to deviation of the club head from the intended line of the putt. The putter should trace a straight line from the start of the back swing, through to the transition from back swing to forward swing and back through the forward swing to contact with the ball.
3. A further reason cited for inaccurate putts is due to accelerating too quickly during back swing and/or forward swing. Ideally, smooth acceleration and deceleration should be achieved at all times during back swing, forward swing and the transition between the two.
4. Rotation of the club head in a direction axial to the intended line of travel of the ball is a further technical inaccuracy in player's putting strokes. The club head should remain approximately parallel with the horizontal plane at all times during the stroke.

Most players generally seek the services of a professional to detect inaccuracies in their putting stroke and to correct them. A player then needs to practice these corrected putting techniques and implement the advice received through repetitive practice. Not only is this method of putting swing correction expensive, it is also often ineffective. When the player is practising the correct stroke, without supervision from their coach, bad habits tend to creep back into their action and the player spends his or her time practicing a technically incorrect stroke.

A more convenient and cost effective solution is for the player to use a device that monitors his stroke during practice and alerts them when a stroke is technically inaccurate. In this way, a player can repetitively practice a correct stroke and mirror it during a game.

There is a large body of prior art that attempts to address the above problem. U.S. Pat. No. 4,930,787 (the '787 patent), in the name of Nobles, discloses a device for attachment to a putter which produces a signal during a puffing stroke if the longitudinal axis of the putter head is rotated out of parallel with the horizontal plane or when the putter head undergoes any clockwise or counter clockwise rotation on the backstroke.

The putting trainer of the '787 patent is designed to be fixed, by means of screws or other fastening means, to the backside of the putter. Hence, a player using this device requires a special training putter to fix the device. It is probable that this putter would have different weight and balance characteristics to a putter the golfer would use during a game. It should be appreciated that it is of greater benefit to practice with a putter that will be used during a game and hence the device of the '787 patent does not effectively address the problems listed above.

Furthermore, the device of the '787 patent does not address the path deviation problem, as mentioned above. Thus, the club head can trace any path during the back swing and no stroke error will be indicated. Hence, the device disclosed in the '787 patent, is deficient in solving the problems of putting stroke inaccuracies as discussed above.

U.S. Pat. No. 5,435,561 (the '561 patent), in the name of Conley, discloses and claims a putting stroke training device comprising an inertial sensor for detecting movement in a direction parallel to the plane of the club face and rotation of the club head in a direction axial to the longitudinal axis of the shaft during putting. The sensor includes an elongated arm mounted on a pivot point which is orientated in a direction perpendicular both to the longitudinal axis of the shaft of the club and also to the plane of the club face.

The design of the device of the '561 patent necessitates that it be installed within the shaft of a putter. This is an obvious deficiency of the device as again, a player must practice with one club with the device installed, and play with a separate club. Hence, as the practice club and playing club will no doubt have different balance points and characteristics, the benefits of putting practice using this device and a practice putter are lost.

U.S. Pat. No. 5,441,269 (the '269 patent), in the name of Henwood, discloses a putting stroke training device that detects when the putter head has accelerated or decelerated too quickly, as in technical inaccuracy 3 described above, and also when the putter head is rotated axially around the vertical axis at the moment of contact between the ball and the club head. This device uses a pendulum actuator and an impact actuator to sense technical faults in the putting stroke.

The device of the '269 patent does not adequately address the problems of stroke inaccuracy as it measures only axial rotation of the club head around the vertical axis at the moment of contact. Hence, a player may execute a stroke that causes the club to rotate axially around the vertical axis during back swing, but may correct this inaccuracy during forward swing before contact that would not be considered a technically correct stroke but the device disclosed in the '269 patent would give no indication to the player of the stroke error.

Furthermore, the device of the '269 patent must be either installed within a cavity in a hollow club head, or secured on top of a club head by means of screws or similar fastening devices. Hence, it also requires practicing putting strokes using a putter that would not be used during play. There is minimal benefit in practicing with a putter having different characteristics to that of a putter used during a game.

Hence, there remains the need for a device for detecting inaccuracies in putting strokes such as those listed above. Furthermore, this device must be capable of being easily attached and unattached to a player's putter so that the same club can be used by a player in practice and in games. The advantage of such a device is that a player can detect and correct technical inaccuracies in their putting stroke and play a round of golf using the same club that has been used to practice shots correctly.

OBJECT OF THE INVENTION

The object of the putting training device of the current invention is to solve one or more of the technical inaccuracies of golfers' putting strokes as defined in the background statement. A further object of the invention is to provide a useful alternative to the known prior art.

DISCLOSURE OF THE INVENTION

In one form, although it need not be the only or indeed the broadest form, the invention resides in a putting trainer device comprising:

at least one track having a neutral position and an active position;

a free moving component located on said track and movable along said track between said neutral position and said active position, said free moving component being biased to said neutral position on said track;

at least one detector operable by said free moving component moving to said active position of said track; and at least one indicator in electrical communication with said detector;

wherein, said indicator issues an alert when said detector is operated by said free moving component moving to said active position on said track.

Preferably, said track is a guided ramp inclined from said neutral position to said active position.

Preferably, said free moving component is a disc magnet.

Suitably, said detector is a magnetic reed switch located adjacent said guided ramp and aligned substantially parallel to said guided ramp.

Optionally, said free moving component is an electrically conductive ball bearing.

Alternatively, said detector is an electrical conductor located on said guided ramp at said active position.

Preferably, said electrical communication is by means of a printed circuit board.

Preferably, said indicator is a speaker.

Optionally, said indicator is a light.

Alternatively, said indicator is a vibration device.

Suitably, said device is attachable to a shaft of a putter and pivotable with respect to said shaft.

Optionally, a level of inclination from said neutral position to said active position on said guided ramps may be adjusted.

Optionally, a levelling pendulum is located within said putting trainer device.

Preferably, there are two said tracks orientated substantially perpendicular to each other.

Further features of the present invention will become apparent from the following detailed description.

DETAILED DESCRIPTION OF THE INVENTION

Figure 1:
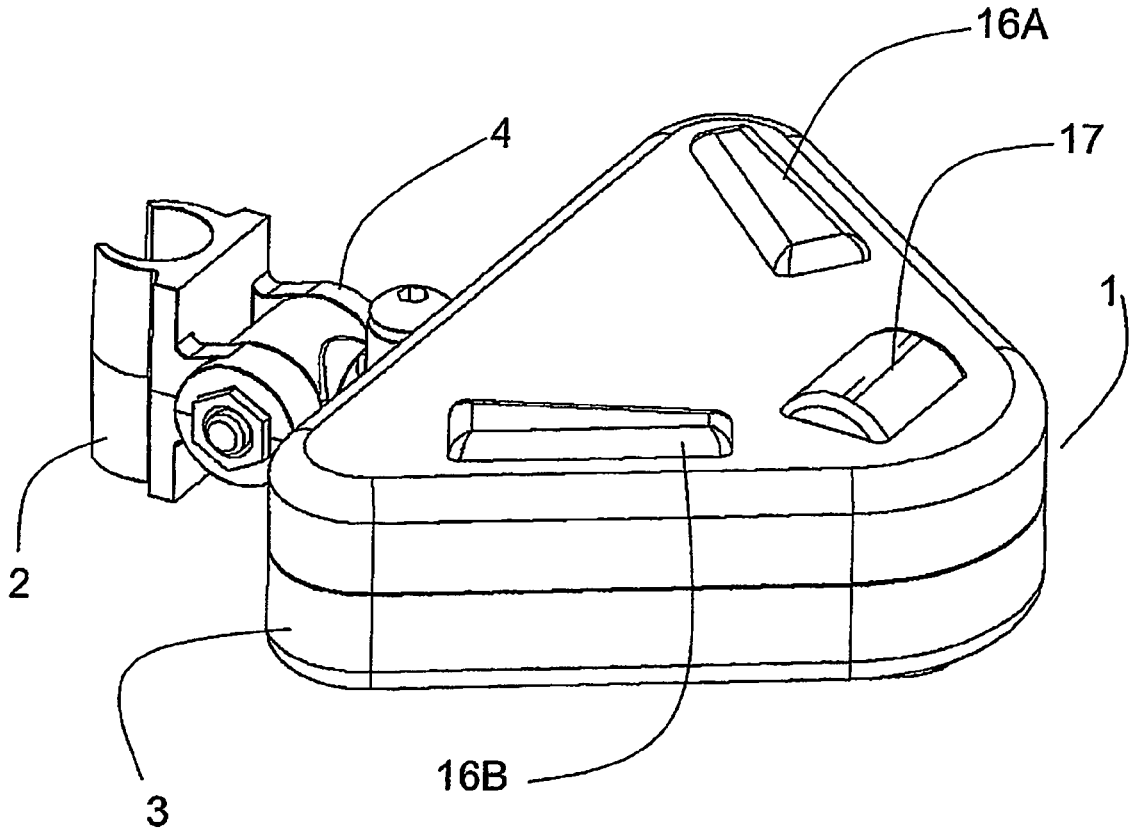
FIG. 1 shows an isometric view of a putting trainer device according to an embodiment of the present invention.
Figure 2:
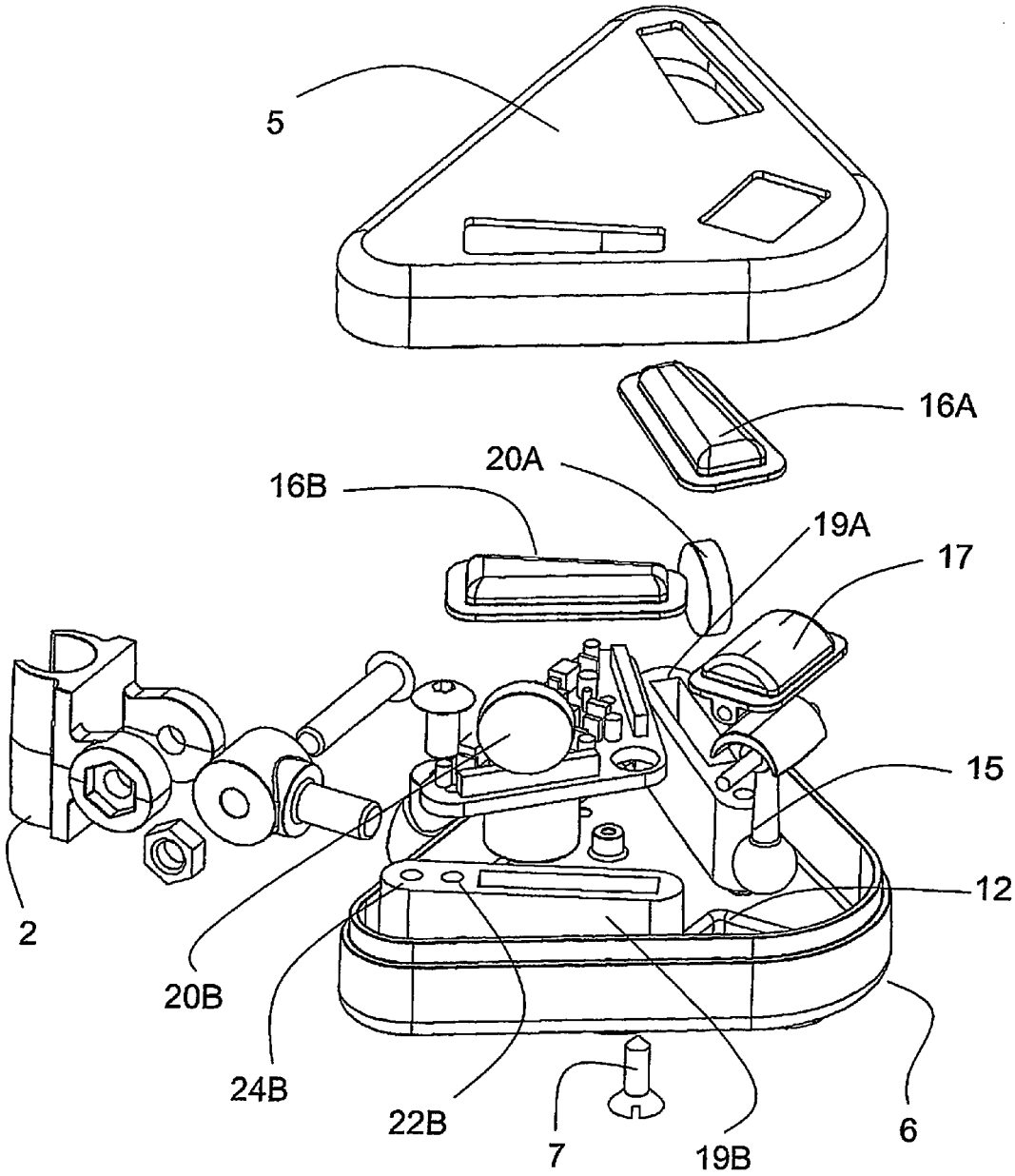
FIG. 2 shows an exploded view of the putting trainer device shown in FIG. 1.
Figure 3:
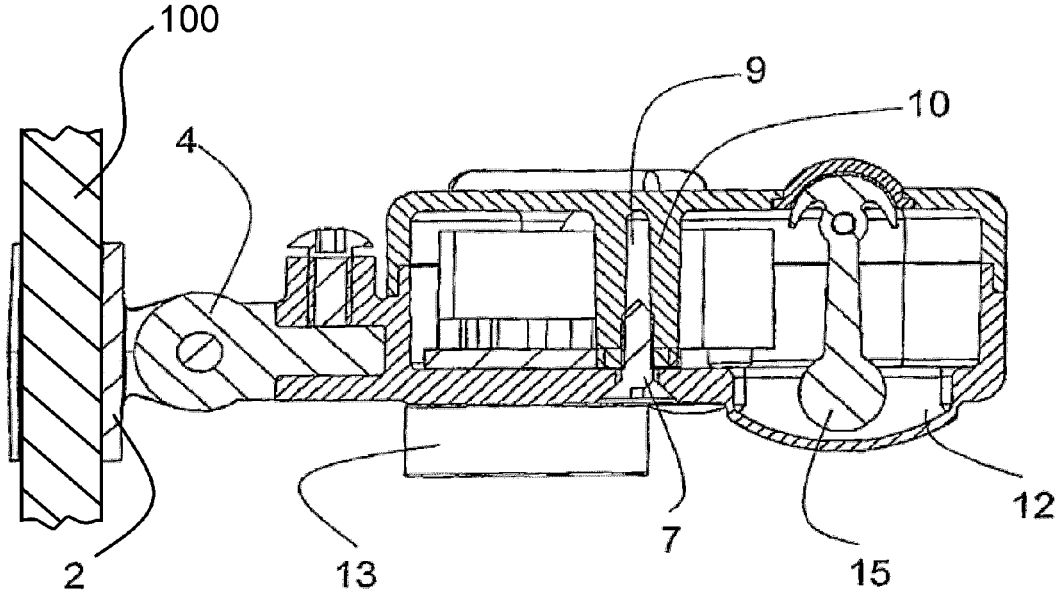
FIG. 3 shows a sectional side view of the putting trainer device shown in FIG. 1.
Figure 4:
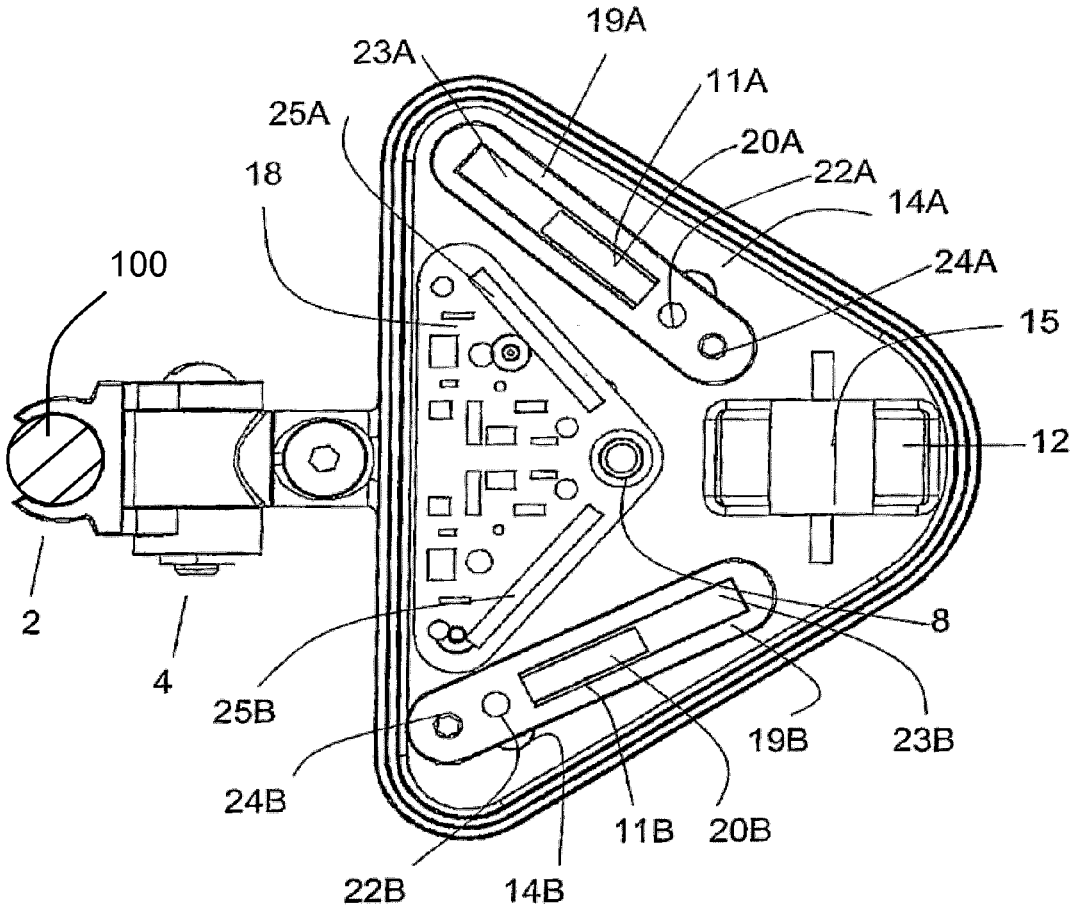
FIG. 4 shows a sectional top view of the putting trainer device shown in FIG. 1.

The present invention relates to a device for detecting inaccuracies in a putting stroke for the game of golf. In particular, this invention relates to a device that detects imperfections in smoothness of stroke, path of the putter head and face angle of the club head during a putting stoke. The device comprises a means for detecting stroke imperfections and a means for indicating when a stroke imperfection has been detected. The putting training device is attached to the shaft of the putter just above the putting head by the means of attachment discussed below. Throughout this description, like numerals are used to refer to the same elements of the invention shown in multiple figures.

One embodiment of the present invention is described below with reference to FIGS. 1-5. Where appropriate, the figure which bests shows the aspect under discussion is referred to. Where no figure is directly referred to it can be inferred that this aspect is present in multiple figures.

With reference to FIG. 1, FIG. 2, FIG. 3, and FIG. 4, an embodiment of the putting trainer device 1 of the present invention is shown. Putting trainer device 1 has a crescent shaped clip attachment means 2 for fixing the putting training device to the shaft 100 of a putter. The attachment means 2 is connected to the detection and indication housing component 3 by way of a pivot 4. Pivot 4 enables vertical movement of the housing component relative to the attachment means and also rotation in a direction axial to the longitudinal axis of the putter head when attached to a putter shaft 100.

The housing component 3 is triangularly shaped with rounded vertices. The housing component 3 comprises two interlocking sections, top section 5 and bottom section 6, fastened by an appropriate means, in this case being a screw 7 through screw hole 8 in bottom section 6 and terminating inside threaded elongated cavity 9 of protruding elongated section 10 which is integrally formed with top interlocking section 5.

The bottom interlocking section 6 further comprises a power switch (not shown), protruding pendulum cavity 12 integrally formed with bottom section 6, battery contact 13, a protruding speaker cavity (not shown) integrally formed with section 6 and guided ramp adjustment screws 14A and 14B. The top interlocking section 5 further comprises a levelling pendulum 15, two clear protruding observation components, 16A and 16B, and a clear protruding pendulum observation component 17.

Pivot 4 is used in conjunction with levelling pendulum 15 and pendulum observation component 17 to level the putting device in the horizontal plane. As many putting shafts are not exactly vertical, this feature ensures that the putting training device 1 of the present invention is substantially parallel with the longitudinal axis of the putter head (not shown) in the horizontal plane.

The bottom interlocking housing section 6 has attached a printed circuit board 18, speaker 26, guided ramps, 19A and 19B, and one free moving component located on each ramp. In this embodiment the free moving component is in the form of free rolling disc magnets, 20A and 20B. Guided ramps 19A and 19B are fixed at an angle that is at 45 degrees to the longitudinal axis of the putter club head in the horizontal plane and are substantially perpendicular to each other.

The guided ramps, 19A and 19B, have elongated threaded cavities, 22A and 22B, in which guided ramp adjustment screws, 14A and 14B, terminate. Elongated threaded cavities, 22A and 22B, are formed within guided ramps, 19A and 19B, distal from disc magnet neutral positions 23A and 23B respectively. Guided ramp attachment screws, 24A and 24B, are located within guided ramps, 19A and 19B, distal from disc magnet neutral positions 23A and 23B respectively.

Guided ramps 19A and 19B are inclined from disc magnet neutral positions 23A and 23B to disc magnet active positions 11A and 11B located on guided ramps 19A and 19B distal from disc magnet neutral positions. The angle of this incline is altered by the tightening or loosening of guided ramp adjustment screws 14A and 14B. Movement of free rolling disc magnets 20A and 20B from disc magnet neutral positions 23A and 23B in a direction along guided ramps 19A and 19B to disc magnet active positions 11A and 11B is detected by magnetic reed switches 25A and 25B located on printed circuit board 18.

Figure 5:
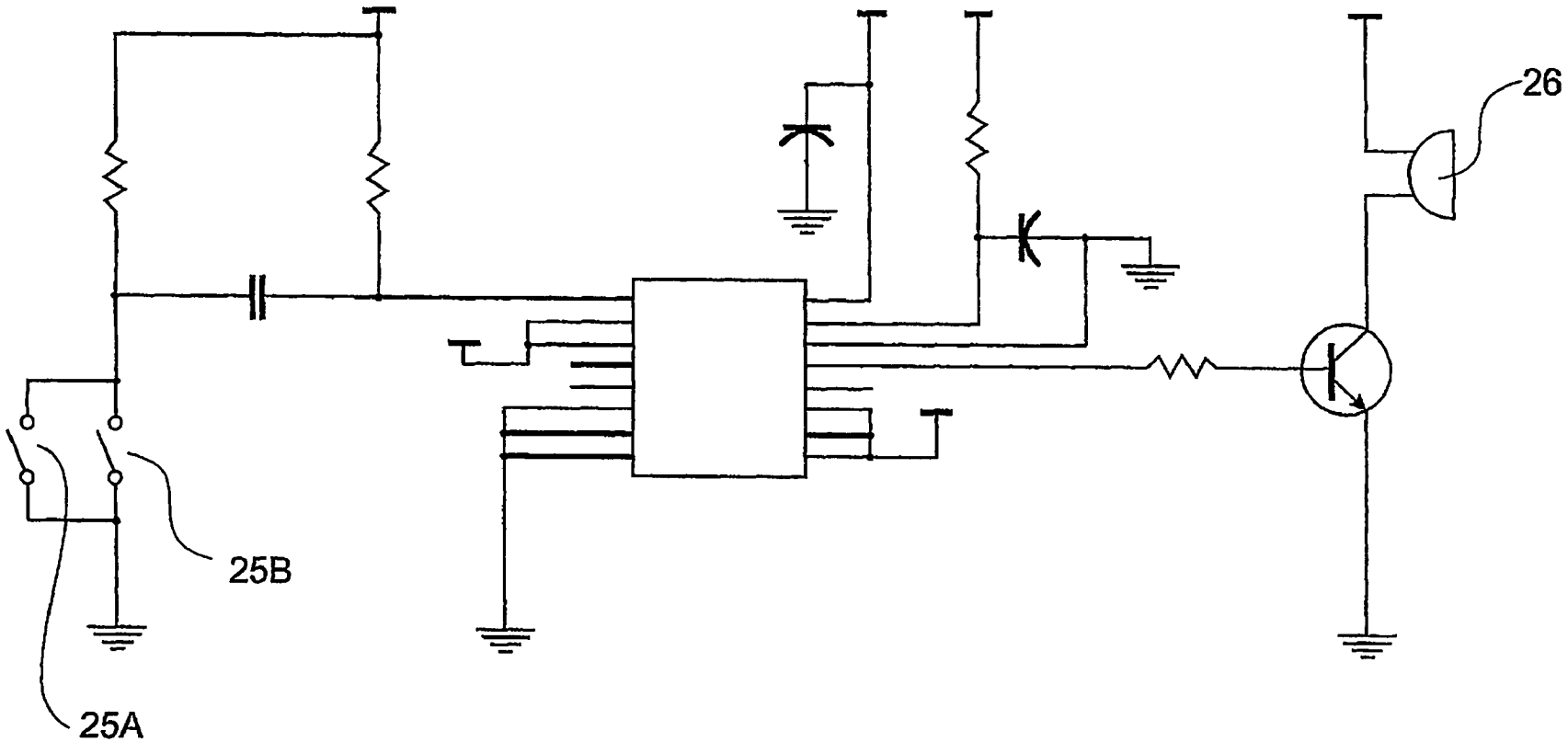
FIG. 5 shows a schematic of a circuit comprising part of the putting training device shown in FIG. 1.

The magnetic reed switches 25A and 25B are aligned substantially parallel to the longitudinal axis of guided ramps 19A and 19B and located adjacent disc magnetic active positions 11A and 11B respectively. These switches are biased open, meaning that no circuit is complete. Upon detection of a repulsive magnetic force the switches close and the circuit shown in FIG. 5 is completed. A person skilled in the art will appreciate that when the circuit is completed, either by closing reed switch 25A and/or by closing reed switch 25B, an alert will be issued by speaker 26 as these switches are in parallel. This will be discussed in more detail below.

Furthermore, a person skilled in the art will appreciate that the free rolling disc magnets 20A and 20B will not cause magnetic reed switches 25A and 25B to close when these magnets are positioned in disc magnet neutral positions 23A and 23B. This is due to the nature of a magnetic field around a disc and the strength of the magnetic force associated with each of disk magnets 20A and 20B.

Upon detection of movement of disc magnets 20A and 20B away from disc magnet neutral positions 23A and 23B to disc magnet active positions 11A and 11B by magnetic reed switches 25A and 25B, an indication is given, providing that the power switch, not shown, is in the ON position and that there is an appropriate power source connected to the electrical circuit of printed circuit board 18 such as by means of a battery inserted in battery contact 13. The indication may be visual, audible or tactile. In the present embodiment of the putting training device 1, indication is given by means of a digital speaker 26 as shown in the schematic of FIG. 5. Speaker 26 is in electrical communication with magnetic reed switches 25A and 25B via printed circuit board 18. When either or both magnetic reed switches 25A and 25B are closed the circuit is complete and an electrical signal is propagated to the speaker 26 causing a sound to be created.

Detection of movement of the magnetic discs along the guided ramps is the primary mechanism for detection of technical inaccuracies in a putting stroke. The putting training device of the present invention detects the four technical inaccuracies as discussed in the background section.

It will be appreciated that as the putting training device is located on the putter shaft 100 just above the club head that the movement of the putting trainer device closely mimics the movement of the club head. Hence, it will be appreciated that the device of the present invention mimics the movement of the putter head.

Rotation of the wrists during the back swing, forward swing or transition between the two produces rotation of the putter club head in a direction axial to the vertical axis. This rotation imparts a rotational force on the putting trainer device.

Consider if, during the back swing, the club head is rotated gently axially around the vertical axis such that the club head rotates in a clockwise direction from a top perspective. At the moment of transition from back swing to forward swing the velocity of the club head is zero as the force applied to the club head by the player through the shaft has changed from back swing to forward swing. In this case, the angle formed by guided ramp 19A and the line of intended travel of the ball is decreased. At the transition stroke momentum is imparted on the free moving disc magnet. A perfect stroke would result in no movement of the free disc magnet as the frictional resistance provided by the walls of guided ramp 19A and the gravitational resistance of the slope of the ramp would provide enough resistance to counter this force. In the rotational situation described above, the guided ramp 19A is aligned in a direction close to the line of intended path of travel of the golf ball. In this situation the resistance offered by the walls of the guided ramp 19A is less as the effective line of force has changed due to the rotation of the club head. If this rotation is great enough the force from the change in momentum imparted on the free rolling disc magnet 20A will be enough to overcome the resistance offered by the walls and the slope of the guided ramp 19A, thus the free rolling disc magnet 20A will move away from the disc magnet neutral position 23A, to disc magnet active position 11A, and will close magnetic reed switch 25A causing an indication of swing error to be communicated to the golfer.

Similar mechanics of motion apply to all axial movement around the vertical axis for the putting training device and hence detection of all axial motion is possible using the same principles as described above.

As discussed in the background section, deviation perpendicular to the intended line of travel of the ball is another technical flaw in golfers' putting strokes. For example, consider that during a back swing the putter head deviates perpendicularly from the intended line of travel of the golf ball in a direction way from the player putting. A perfect stroke would only have forces acting in the direction of the intended line of travel of the golf ball and, as discussed, this force is not sufficient to move the free rolling disc magnets 20A and 20B from their neutral positions 23A and 23B to their active positions 11A and 11B. In the deviation situation described above, a momentum force is applied in a direction perpendicular to the intended line of travel of the golf ball at the transition stroke. If this force is large enough to overcome the frictional forces of guided ramp 19A and the gravitational force imparted by the slope of guided ramp 19A then free rolling disc magnet 20A will move away from the disc magnet neutral position 23A, to disc magnet active position 11A, and will close magnetic reed switch 25A.

Similar principles apply to movement of the club head perpendicular to the line of intended travel of the golf ball in the direction of the player making the putt.

As discussed in the background section, players can miss putts because they tend to accelerate and decelerate the club head too erratically during the stroke. The putter training device of the current invention is capable of detecting when a player's stroke is not smooth enough.

A person skilled in the art would appreciate the fact that a body under acceleration has a force associated with it, the magnitude of which depends on its mass and level of acceleration. If the acceleration or deceleration of the putter head is excessive, the momentum force imparted on the free rolling disc magnets 20A and 20B will be great enough to overcome the resistive forces of the guided ramps 19A and 19B and the gravitational force applied by the slopes of the guided ramps on the free moving disc magnets. Hence, the free rolling disc magnets 20A and 20B will move away from the disc magnet neutral positions 23A and 23B, to disc magnet active positions 11A and 11B respectively, and will close magnetic reed switches 25A and 25B respectively.

Depending on the direction of the acceleration and deceleration of an incorrect swing, either free rolling disc magnet 20A will move, free rolling disc magnet 20B will move or both will move causing the corresponding reed switches too close and thus initiating the indication means.

A further technical defect that is present in golf players' putting strokes is that they tend to rotate the club head in an axial direction around the line of the intended path of the golf ball. In this regard, a perfect stroke would have zero rotation of the longitudinal axis of the putter club head around the line of the intended path of the ball.

The golf putting trainer of the present invention is also able to detect rotation of this type and indicate its occurrence to the player. For example, consider the situation when a putter is rotated axially to the line of the intended path of travel of the ball in a direction so that the end of the puffer head distal from the shaft is lower than the end proximal to the shaft. In this situation, if the angle of rotation is great enough, free rolling disc magnet 20A will move away from disc magnet neutral position 23A, to disc magnet active position 11A, as the disc magnet overcomes the resistive forces of guided ramp 19A and the slope of this ramp is diminished due to this rotation. Hence, magnetic reed switch 25A will close and thus initiating the indication means. A similar result will occur for disc magnet 20B if rotation occurs in the other axial direction.

A person skilled in the art will appreciate that a combination of one or more of the motions discussed above will not impede the accurate detection and indication of technical inaccuracies in a putting stroke by the puffing trainer device of the present invention.

As previously mentioned, the sensitivity of the golf putting trainer 1 can be altered by changing the inclination of the guided ramps 19A and 19B. This is an advantage as the device caters for all levels of golfers, from the weekend player to the professional. Furthermore, the device can be altered to increase the sensitivity as a player's putting technique improves. Thus, the perfect stroke for that player will become more difficult to attain and hence the skill level of the player will be increased.

It will be appreciated by a person skilled in the art that the free moving disc magnet and magnetic reed switches are not the only means of detection for the present invention. In alternative embodiment of the present invention, using the same principles described above it is possible to replace the disc magnets with ball bearings. In this embodiment an electrical conductor is located at the active position on the guided ramps and the movement of the ball to the active position would, upon contact with the electrical conductor at the active position, complete an electrical circuit to initiate the indication means.

Throughout the specification the aim has been to describe the preferred embodiments of the invention without limiting the invention to any one embodiment or specific collection of features. Thus the invention should be limited only in accordance with the following claims.

The invention claimed is:

1. A putter trainer device comprising:

a first track having a first neutral position and a first active position;

a first component located on said first track, said first component being movable along said first track between said first neutral position and said first active position, said first component being biased to said first neutral position on said first track;

a first detector operable by said first component moving to said first active position of said first track;

a second track having a second neutral position and a second active position;

a second component located on said second track, said second component being moveable along said second track between said second neutral position and said second active position, said second component being biased to said second neutral position on said second track;

a second detector operable by said second component moving to said second active position of said second track; and an indicator in electrical communication with said first detector and said second detector;

wherein, said indicator issues an alert when said first detector is operated by said first component moving to said first active position on said first track or said second component moving to said second active position on said second track;

wherein said first component is a disc magnet.

2. The putting trainer device of claim 1, wherein said first track is a guided ramp inclined from said first neutral position to said first active position.

3. The putting trainer device of claim 2, wherein said first detector is an electrical conductor located on said guided ramp at said first active position.

4. The putting trainer device of claim 1, wherein said electrical communication is by means of a printed circuit board.

5. The putting trainer device of claim 1, wherein said indicator comprises at least one of a speaker, a light, and a vibration device.

6. The putting trainer device of claim 1, wherein said first track and said second track are orientated substantially perpendicular to each other.

7. The putting trainer device of claim 1, wherein said first track has a centrally disposed linear first axis extending along the length thereof and said second track has a centrally disposed linear second axis extending along the length thereof, said first axis and said second axis intersecting to form an inside angle that is less than 180°.

8. A putter trainer device comprising:

a first track having a first neutral position and a first active position;

a first component located on said first track, said first component being movable along said first track between said first neutral position and said first active position, said first component being biased to said first neutral position on said first track;

a first detector operable by said first component moving to said first active position of said first track;

a second track having a second neutral position and a second active position;

a second component located on said second track, said second component being moveable along said second track between said second neutral position and said second active position, said second component being biased to said second neutral position on said second track;

a second detector operable by said second component moving to said second active position of said second track; and an indicator in electrical communication with said first detector and said second detector;

wherein, said indicator issues an alert when said first detector is operated by said first component moving to said first active position on said first track or said second component moving to said second active position on said second track;

wherein said first track is a guided ramp inclined from said first neutral position to said first active position; and wherein said first detector is a magnetic reed switch located adjacent said guided ramp and aligned substantially parallel to said guided ramp.

9. A putter trainer device comprising:

a first track having a first neutral position and a first active position;

a first component located on said first track, said first component being movable along said first track between said first neutral position and said first active position, said first component being biased to said first neutral position on said first track;

a first detector operable by said first component moving to said first active position of said first track;

a second track having a second neutral position and a second active position;

a second component located on said second track, said second component being moveable along said second track between said second neutral position and said second active position, said second component being biased to said second neutral position on said second track;

a second detector operable by said second component moving to said second active position of said second track; and an indicator in electrical communication with said first detector and said second detector;

wherein, said indicator issues an alert when said first detector is operated by said first component moving to said first active position on said first track or said second component moving to said second active position on said second track;

wherein said first track is a guided ramp inclined from said first neutral position to said first active position; and wherein said guided ramp is attached to a housing surface so as to form an inside angle therebetween, and wherein said guided ramp is movable between a first ramp position and a second ramp position so as to adjust said inside angle such that a level of inclination from said first neutral position to said first active position on said guided ramp is adjusted.

10. The putting trainer device of claim 9, further comprising an adjustment screw threaded into said guided ramp, wherein the angle between said guided ramp and said housing is changed by rotating said adjustment screw.

11. A putter trainer device comprising:

a first track having a first neutral position and a first active position;

a first component located on said first track, said first component being movable along said first track between said first neutral position and said first active position, said first component being biased to said first neutral position on said first track;

a first detector operable by said first component moving to said first active position of said first track;

a second track having a second neutral position and a second active position;

a second component located on said second track, said second component being moveable along said second track between said second neutral position and said second active position, said second component being biased to said second neutral position on said second track;

a second detector operable by said second component moving to said second active position of said second track; and an indicator in electrical communication with said first detector and said second detector;

wherein, said indicator issues an alert when said first detector is operated by said first component moving to said first active position on said first track or said second component moving to said second active position on said second track; and further comprising a leveling pendulum disposed therein.

* * * * *